United States Patent [19]

Stolov et al.

[11] 4,410,887

[45] Oct. 18, 1983

[54] LARGE ELECTRONICALLY CONTROLLED LIQUID CRYSTAL DISPLAYS OF ONE OR MORE COLORS

[76] Inventors: Michael Stolov; Adi Stolov, both of 25 Hapoel St., Hof-Yam, Herzilia, Israel

[21] Appl. No.: 219,952

[22] Filed: Dec. 24, 1980

[30] Foreign Application Priority Data

May 25, 1980 [IL] Israel ..... 60156

[51] Int. Cl.[3] ..... G09G 3/36

[52] U.S. Cl. ..... 340/784; 340/765; 340/701; 350/352; 350/330; 350/344

[58] Field of Search ..... 340/701, 703, 765, 784; 350/330–337, 352, 344, 343, 351; 128/644, 667, 736

[56] References Cited

U.S. PATENT DOCUMENTS

| | | | |
|---|---|---|---|
| 3,568,177 | 3/1971 | Hasler | 340/701 |
| 3,576,364 | 4/1971 | Zanoni | 340/784 |
| 3,806,227 | 4/1974 | Greubel et al. | 350/337 |
| 3,847,139 | 11/1974 | Flam | 128/736 |
| 3,899,786 | 8/1975 | Greubel et al. | 340/703 |
| 3,978,580 | 9/1976 | Leupp et al. | 350/344 |
| 4,064,872 | 12/1977 | Caplan | 350/351 |
| 4,086,514 | 4/1978 | Havel | 340/703 |
| 4,299,447 | 11/1981 | Soltan et al. | 350/334 |

FOREIGN PATENT DOCUMENTS

| | | | |
|---|---|---|---|
| 1522472 | 8/1978 | United Kingdom | 313/489 |

*Primary Examiner*—Marshall M. Curtis
*Attorney, Agent, or Firm*—Browdy and Neimark

[57] ABSTRACT

A large liquid crystal display panel, assembled from many smaller sized liquid crystal panels, each carrying a small portion of a larger character or image. The liquid crystals panels may be carried on a common support. For providing the liquid crystal panels, with changeable colors, a new shape of an electrode-matrix is proposed, which have on one inside surface of the liquid crystal panel, electrodes in the form of the desired character or image and on a second inside surface, electrodes in the form of narrow strips, which are disposed on coated narrow strips of different colors. The energization of the electrodes is electronically controlled to effect the appearance of characters or images in different, changeable colors. The large liquid crystal panels can be transmissive, reflective or transflective.

17 Claims, 10 Drawing Figures

LARGE ELECTRONICALLY CONTROLLED LIQUID CRYSTAL DISPLAYS OF ONE OR MORE COLORS

BACKGROUND OF THE INVENTION

This invention relates to a liquid crystal display providing large and even extremely large characters and/or images, which heretofore was impossible by known techniques. More particularly, the present invention allows one to provide the characters and/or images using electronically controlled colors, with very good resolution and wide view angles.

SUMMARY OF THE INVENTION

The present invention provides a possibility of obtaining extremely large displays of characters and/or images without using projection apparatus. A flat large screen, which can for example be hung on a wall or the like, is especially useful for announcements and advertisements, which can be seen from afar. Reflective screens can be provided for outdoor, daylight use. These reflective screens are also useful in very bright rooms. Transmissive screens can be used in darkness. As opposed to large projecting devices, this type of the screen, according to the present invention, does not require significant depth and can be practically used in all circumstances. In accordance with the present invention, it is not necessary to use additional color filters for obtaining characters and/or images having selectively and/or partially changeable colors.

DESCRIPTION OF THE PREFERRED EMBODIMENTS

Figure 2:
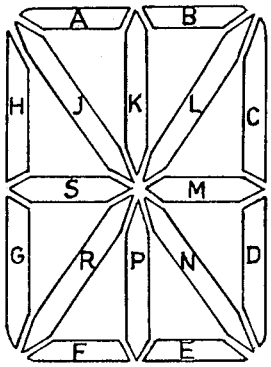
FIG. 2 shows an ordinary alpha-numeric character which, according to the present invention, can be displayed in very large sizes.
Figure 3:
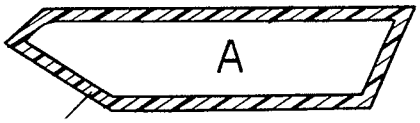
FIG. 3 shows the segment "A" of the alpha-numeric character from FIG. 2, as an independent display unit, used according to the present invention to provide a large character, such as one five inches high.
Figure 5:
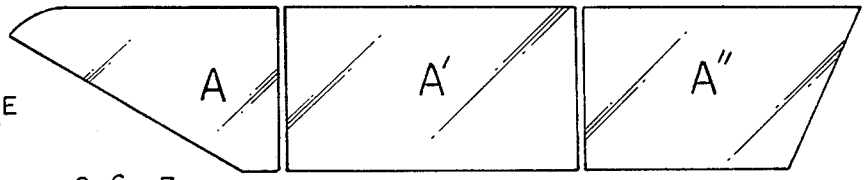
FIG. 5 shows the same segment "A" assembled from three independent liquid crystal units to provide an extremely high alpha-numeric character, such as one twelve inches high.

Prior to the present invention, liquid crystal displays up to one inch high have been available. It has been most difficult to produce higher characters and those of more than three inches cannot be produced by known, conventional techniques. According to the new concept of the present invention, liquid crystal displays having characters of unlimited size can be easily produced. According to the present invention, the character-forming display is divided into many parts, each of the parts being an independent liquid crystal display of a regular size. For example, the alpha-numeric character display of FIG. 2, is divided into 16 parts, where each segment is an independent liquid crystal unit of regular size, as shown in FIG. 3. If the segment "A" of FIG. 2 is 2.5 inches long, the assembled character display will become seven inches high. In FIG. 5 is shown the segment "A", which is assembled from three parts, A, A', and A", having a combined length of six inches. In this case, the assembled alpha-numeric character display will become eighteen inches high.

Figure 1:
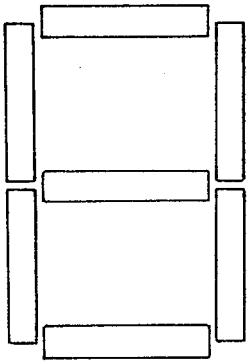
FIG. 1 shows an ordinary seven-segment character which, according to the present invention, can be displayed in very large sizes.
Figure 10:
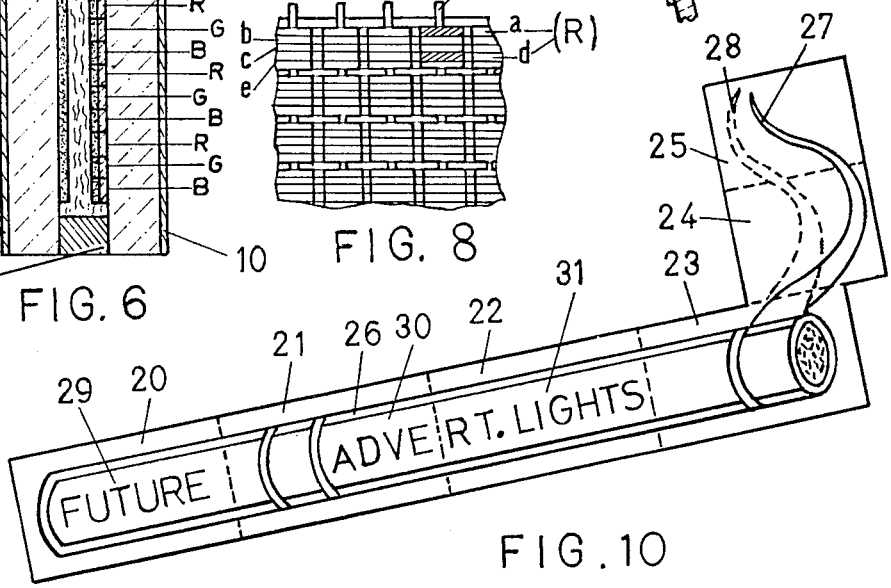
FIG. 10 is an example of a large liquid crystal panel, composed of six liquid crystal displays, which create together an image of a burning cigarette, with an image of moving smoke and advertisement text.

In the same fashion one obtains other characters. For example, one can provide a seven segment display, as in FIG. 1 or a dot character, as in FIG. 8, using independent liquid crystals for each segment. Also moving images can be obtained. For example, in FIG. 10 is shown an image of a cigarette, with a moving or jumping smoke, and with changeable text signs for advertising purposes. This advertising panel has two advantages, as compared with gas-discharge advertising devices. Firstly, the panels according to the present invention do not need any high voltage supply. Secondly, negligible energy is required for the electronic control circuits.

Figure 9:
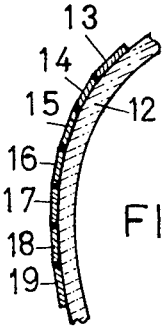
FIG. 9 shows a large liquid crystal panel composed from many small liquid crystal displays which are assembled on a curved surface.

According to a variant of the present invention, curved liquid crystal panels can be obtained, as shown in FIG. 9. Here small flat liquid crystal displays 13–19 are assembled together on a curved support 12, forming a curved liquid crystal device.

According to some embodiments of the present invention, the large liquid crystal displays, can become multicolored, where the colors can be electronically controlled, locally and selectively.

Figure 6:
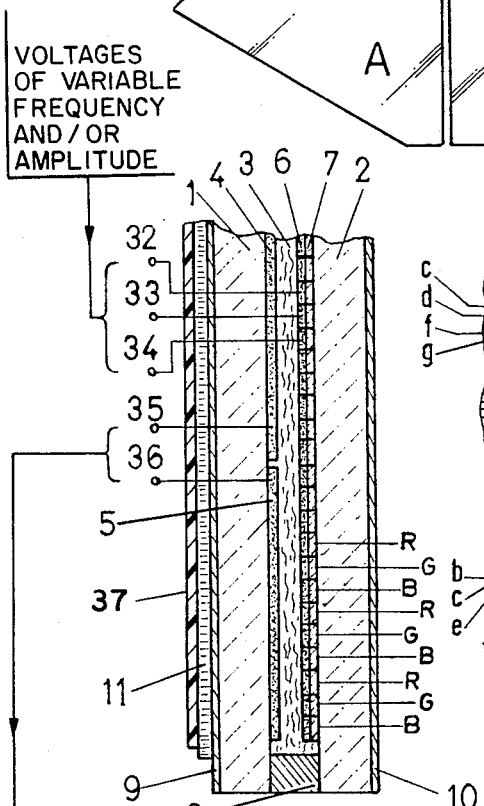
FIG. 6 is a detailed sectional view of a liquid crystal display for displaying characters and/or images in different colors, which can be electronically controlled.

The concept of a multicolor liquid crystal display is shown in FIG. 6. According to the present invention, the multicolor display includes two glass plates 1 and 2, separated from one another by a frame 8, and between which is disposed a liquid crystal fluid 3. The external surfaces of the glass plates 1 and 2, are covered respectively with polarizers 9 and 10. A member 11 with a reflecting surface is provided over the outer surface of the plate 1, in case the display is to be reflective. In case the display is to be transmissive, the member 11 would be a frosted glass or frosted plastic sheet. The sheet 11 can be applied on the second polarizer 10, instead of on the first polarizer 9, or it can be disposed at a small distance from either of the polarizers 9, 10, without changing the results in the reflective and transmissive cases.

Inside of the display, the inner surface of glass plate 1, is coated with electrodes 5 and/or 4, which have the form of the desired character or part of any character and/or image. The second glass plate 2, is coated with narrow colored strips 7, which are at the same time transparent electrical conductors. For example, this can be done, coating the glass plate 2 of FIG. 6, with narrow strips of different translucent colors 7, and then covering the colored strips with strips of transparent electrical conductors 6, of the same shape. The strips of different colors can be painted on the other glass plate 1, under the character electrodes 5, 4, but they must be placed exactly opposite the corresponding electrode strips 6. The strips 6 and 7 can be applied in opposite order. Firstly the inner surface of the glass plate 2 would be coated with the transparent electrical conductors 6 and then the electrodes 6 would be painted with the strips 7 of translucent colors in the form of narrow strips. What is very important according to the present invention is, for good purity of the colors in a wide view angle, the colored strips 7 must be inside of the liquid crystal display. This concept allows one to produce the displays with very narrow color strips and high density, so even from near distance they will not detract from the impression of good resolution; moreover, the display for this reason can be produced also as a reflective device. The colors of the strips can be red, green and blue, or others, as desired.

In the event the display of FIG. 6 is to be used in the dark or in insufficiently bright rooms or the like, a suitable light source, should be provided. The said strips can have a rectangle, polyhedral traingle or a round form.

Figure 4:
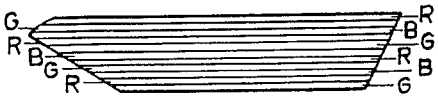
FIG. 4 shows the segment "A" of FIG. 3, arranged for multicolor displaying, according to the present invention.

To explain briefly how the present invention works, reference is made by way of example to the segment "A" of an alpha-numeric character, which character portion electrode is shown in FIG. 3, while the color electrodes are shown in FIG. 4. While activating the segment electrode "A", which shape is shown in FIG. 3, and simultaneously all red (R) counter-electrodes of FIG. 4, which are in form of narrow strips, the segment "A", will be seen in red color. Were all green(G) strips energized, the segment "A" would be green in color. Were all blue strips (B) energized, the given segment "A" would be seen in blue color. Also by simultaneously energizing the red, blue and green electrodes in various combinations, mixing of these colors is possible to obtain other colors. In case the display is to be transmissive, it is advantageous to apply on the surface of member 11, a mask 37, as in FIG. 3 and FIG. 6, corresponding to the size and shape of the individual segments, as this increases the sharpness of the image.

By supplying the striped counter-electrodes with voltages of different frequencies, is possible to change the light transmission locally changing the saturation of the colors; thus, it is possible to obtain by mixing of the colors, all possible colors. The principle of modulating light intensity of liquid crystal displays by means of supplying to the electrodes voltages of changeable frequency, is explained in an earlier application of Michael Stolov filed on May 14, 1979 under Ser. No. 38,844, now issued as U.S. Pat. No. 4,368,963, which is incorporated herein in its entirety by reference. The upper three of the electrodes 6 are shown connected to respective leads 32, 33 and 34 which are designated as being connected to separate sources of voltage of variable frequency and/or amplitude. In practice sometimes, all red electrodes can be convicted to one source, all blue to a second source, and all green to a third source. In some applications more sources could be provided, with one for each electrode being the ultimate limit. The electrodes 4 and 5 are shown connected to respective leads 35 and 36 which are designated as being connected to points of reference potential via respective switches. The reference potential can be a common for all the sources including those which supply the variable frequency and/or amplitude voltages to the electrodes 6.

Figure 7:
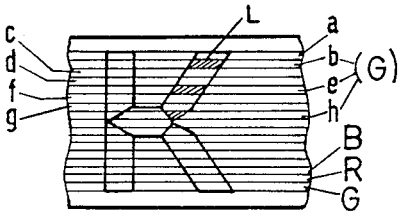
FIG. 7 is a front view of one alpha-numeric character "K" of small size, which is developed as a multicolor display.
Figure 8:
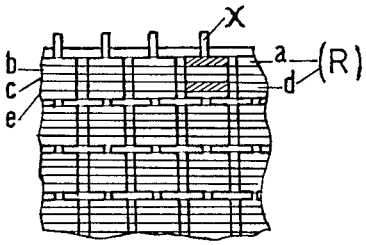
FIG. 8 is a front view of "dot" character, which is developed as a multicolor display.

Because the color strips are inside of the liquid crystal display and, as it was explained the density of the strips according to the present invention can be made very high, the concept of the present invention can be also applied to obtain smaller multicolor displays, as it is shown in FIG. 7 and in FIG. 8. In FIG. 7 is shown a new kind of a matrix constructed from an alphanumeric character electrode, which is disposed on one inner surface of the liquid crystal display, while on the other inner surface is disposed a plurality of colored strips and a plurality of counterelectrodes in the form of narrow strips, a, b, c, d, e and so on. For example, while energizing one segment electrode for example "L", and simultaneously all green color counterelectrodes, b, e, and h, the segment "L" will be seen in the color green. In the same way other colors can be activated. In order to make the FIG. 7 clear, only three strips are shown for a given color. In practice, many more strips for each color must and can be provided. The same can be done with liquid crystal displays, which have a seven segment character, or a dot character as in FIG. 8. Energizing the column "X" of FIG. 8, and simultaneously the counter electrodes, strips a and d, which are red, the crossed dot will become visible in the color red.

All of these principles are applied in an example of a liquid crystal image display for advertising in FIG. 10. The display is assembled from 6 regular size parts, 20, 21, 22, 23, 24, and 25. All together these parts 20–25 create an image of a lighted cigarette, with an image of moving or with a jumping smoke 27 or 28, in changeable colors and changeable advertising text 29, 30 and 31.

Of course, the large liquid crystal display can also become multicolored, by lighting up them by means of light sources of different colors. This method however, requires powerful drivers for the light sources and accompanied with high energy consumption from the electronic circuits.

What is claimed is:

1. A large liquid crystal display comprising a common support, said common support being electrically and optically passive as to the display and as to the images displayed, said large display being directly viewable and comprising a plurality of independent liquid crystal display units individually mounted on said common support; each of said independent units comprising part of an overall larger predetermined image display, each said independent unit comprising electrode means with power leads corresponding in shape to its respective part of said overall larger display, each said unit being independently defined and separated from all of its companion units on said common support by sealing frame means; and said sealing frame means being sufficiently narrow that said overall larger image display appears to a viewer to be continuous and uninterrupted.

2. A large liquid crystal display according to claim 1, wherein said plurality of units are positioned and arranged on said support to produce at least one character from a seven segment image.

3. A large liquid crystal display according to claim 1, wherein said plurality of units are positioned and arranged on said support to produce at least one character as an alpha-numeric image.

4. A large liquid crystal display according to claim 1, wherein said plurality of units are positioned and arranged on said support to produce at least one character from dots.

5. A large liquid crystal display according to claim 1, wherein said plurality of units are positioned and arranged on said support to produce at least one character as said image.

6. A large liquid crystal display according to claim 1, wherein said support has a curved form.

7. A large liquid crystal display according to claim 1, including at least one light source for lighting up said overall larger image.

8. A large multi-color liquid crystal display comprising a plurality of separate liquid crystal display units, each of said separate units comprising part of said overall large multi-color display and each separate unit comprising at least one transparent electrode in the form of the part of said overall large multi-color display which the particular separate unit adds to the overall image, said electrode being provided on one inner surface of said unit, striped counter-electrodes and differently colored strips provided on another inner surface of said unit, said color strips being independent of and separate from said electrode and said striped counter-electrodes, electric leads to said electrodes, whereby a large, sharp multi-color display is provided, and said striped counter-electrodes and said color strips being sufficiently narrow that the color of each unit appears to a viewer to be continuous and uninterrupted.

9. A liquid crystal display according to claim 8, wherein said color strips are translucent paints disposed between an inner glass surface and said striped counter-electodes.

10. A liquid crystal display according to claim 8, wherein said colored strips are disposed between an inner glass surface and said at least one electrode.

11. A liquid crystal display according to claim 8, including means to energize said striped counter-electrodes to modulate the light intensity passing through said striped counter electrodes.

12. A liquid crystal display according to claim 8, including at least one white light source for lighting up image displayed.

13. A liquid crystal display according to claim 8, including a scattering translucent sheet and a mask corresponding to the shape of the image displayed.

14. A liquid crystal display according to claim 8, wherein said counter-electrodes and colored strips, have a geometrical form.

15. A liquid crystal display according to either one of claims 1 or 8, wherein the display directly and as seen by a viewer is at least three inches high.

16. A large liquid crystal display according to claim 6, wherein said independent units are small flat units so positioned on said curved support as to produce on overall display which appears to a viewer to be curved.

17. The display of claim 8, wherein said striped counter-electrodes and said color strips are juxtaposed on each other.

* * * * *